US010001328B1

(12) United States Patent
Parker et al.

(10) Patent No.: US 10,001,328 B1
(45) Date of Patent: Jun. 19, 2018

(54) CHARGING HANDLE ASSEMBLY FOR FIREARM

(71) Applicant: Falcon 37, Inc., Fayetteville, NC (US)

(72) Inventors: Steven C. Parker, Fayetteville, NC (US); Allen Wendell Moore, Cary, NC (US); Samuel Clay Felts, Jr., Cary, NC (US); Ryan Scott Bishop, Cary, NC (US); Nathan James Metty, Cary, NC (US)

(73) Assignee: Falcon 37, Inc., Fayetteville, NC (US)

( * ) Notice: Subject to any disclaimer, the term of this patent is extended or adjusted under 35 U.S.C. 154(b) by 0 days. days.

(21) Appl. No.: 14/980,129

(22) Filed: Dec. 28, 2015

Related U.S. Application Data

(60) Provisional application No. 62/097,032, filed on Dec. 27, 2014.

(51) Int. Cl.
*F41C 23/02* (2006.01)
*F41C 23/14* (2006.01)
*F41A 3/72* (2006.01)

(52) U.S. Cl.
CPC ..... *F41A 3/72* (2013.01)

(58) Field of Classification Search
CPC ..... F41C 23/02; F41C 23/04; F41C 23/14; F41C 23/20; F41A 3/71
USPC ..... 89/1.4; 42/90, 94; 73/167
See application file for complete search history.

(56) References Cited

U.S. PATENT DOCUMENTS

| | | | | |
|---|---|---|---|---|
| 8,887,612 | B2 | 11/2014 | Bayly | |
| 9,228,795 | B1 * | 1/2016 | Kielsmeier | F41C 23/14 |
| D787,625 | S * | 5/2017 | Parker | D22/108 |
| 2016/0363415 | A1 * | 12/2016 | Kielsmeier | F41C 23/14 |

* cited by examiner

*Primary Examiner* — Michael D David
(74) *Attorney, Agent, or Firm* — NK Patent Law, PLLC

(57) ABSTRACT

A charging handle assembly for a firearm includes: a charging handle frame having a forward end configured for insertion into an upper receiver of a firearm, a central portion connected to and extending rearward from the forward end, and a base extending rearward from the central portion; a latch arm having a forward hook, the latch arm attached to the central portion of the charging handle frame, the forward hook biased toward the central portion of the charging handle frame to secure the charging handle frame relative to an upper receiver of a firearm; and a cheek rest attached to the base of the charging handle frame. The latch arm is configured to releasably engage the upper receiver of a firearm when the cheek rest is pushed forward and to disengage the upper receiver of the firearm when the cheek rest is pulled rearward.

19 Claims, 8 Drawing Sheets

CHARGING HANDLE ASSEMBLY FOR FIREARM

CROSS-REFERENCE TO RELATED APPLICATION

This application claims the benefit of priority of U.S. provisional patent application No. 62/097,032, titled "Charging Handle for Firearm," filed on Dec. 27, 2014, which is incorporated herein in its entirety by this reference.

TECHNICAL FIELD

The present disclosure relates to a beneficial component for a firearm. More particularly, the present disclosure relates to a charging handle assembly having a mounted structure serving both as a cheek rest and a handle for loading and clearing of a firearm.

BACKGROUND

The AR-15 style rifle, also called an M4, is highly popular with militaries, law enforcement agencies, and shooting enthusiasts. Developed in the late 1950s, a conventional AR-15 has a charging handle that must be pulled rearward to accomplish loading and clearing. This presents a problem to shooters who want a cheek rest to rapidly acquire and keep their sight picture through aiming optics. A convention charging handle, when pulled rearward, overhangs a typical rearward stock, and so a cheek rest cannot typically be mounted on a stock without either interfering with the charging-handle action or being placed disadvantageously low relative to aiming optics. In some cases, in order to properly see through the optics, a shooter must raise a cheek off the stock or any conventional cheek rest mounted there for sighting in on a target. Whether time and accuracy costs lives or just points in shooting competitions, an improved cheek rest arrangement is needed.

SUMMARY

This Summary is provided to introduce in a simplified form concepts that are further described in the following detailed descriptions. This summary is not intended to identify key features or essential features of the claimed subject matter, nor is it to be construed as limiting the scope of the claimed subject matter.

In at least one embodiment, a charging handle assembly for a firearm includes: a charging handle frame having a forward end configured for insertion into an upper receiver of a firearm, a central portion connected to and extending rearward from the forward end, and a base extending rearward from the central portion; a latch arm having a forward hook, the latch arm attached to the central portion of the charging handle frame, the forward hook biased toward the central portion of the charging handle frame to secure the charging handle frame relative to an upper receiver of a firearm; and a cheek rest attached to the base of the charging handle frame.

In at least one example, the cheek rest is laterally wider than the forward end of the charging handle frame.

In at least one example, the cheek rest includes: a rigid component engaging the base of the charging handle frame; and an outer flexible contact component upon the rigid component.

In at least one example, the cheek rest includes ridges to facilitate grasping.

In at least one example, the latch arm further includes: a central base connected to the forward hook; and a rearward lever connected to the central base, the rearward lever biased away from the central portion of the charging handle frame.

In at least one example, the charging handle assembly includes a pin around which the latch arm is pivotable and a spring that biases the rearward lever away from the central portion of the charging handle frame thereby biasing the forward hook toward the central portion of the charging handle frame as the pin serves as a fulcrum.

In at least one example, the latch arm is installed partially into a channel formed by the charging handle frame.

In at least one example, the spring is compressed into a receptacle portion of the channel by the rearward lever.

In at least one example, the channel is formed in a lateral side of the charging handle frame.

In at least one example, the charging handle frame includes an upper overhang and a lower overhang between which the channel is defined.

In at least one example, the forward hook includes a tooth having a forward facing ramp.

In at least one example, the forward hook includes a rearward facing ramp.

In at least one example, the latch arm is configured to releasably engage the upper receiver of a firearm when the cheek rest is pushed forward and to disengage the upper receiver of a firearm when the cheek rest is pulled rearward.

In at least one example, the cheek rest cups partially around the base of the charging handle frame.

In at least one example, a detent is formed in the central portion of the charging handle frame to receive a rearward extension of an upper receiver of a firearm.

In at least one example, the base of the charging handle frame has at least one registration detent that engages the cheek rest.

BRIEF DESCRIPTION OF THE DRAWINGS

The following detailed descriptions are to be read in view of the drawings, which illustrate particular exemplary embodiments and features as briefly described below. The descriptions, however, are not limited to only those embodiments and features explicitly illustrated.

DETAILED DESCRIPTIONS

Figure 1A:
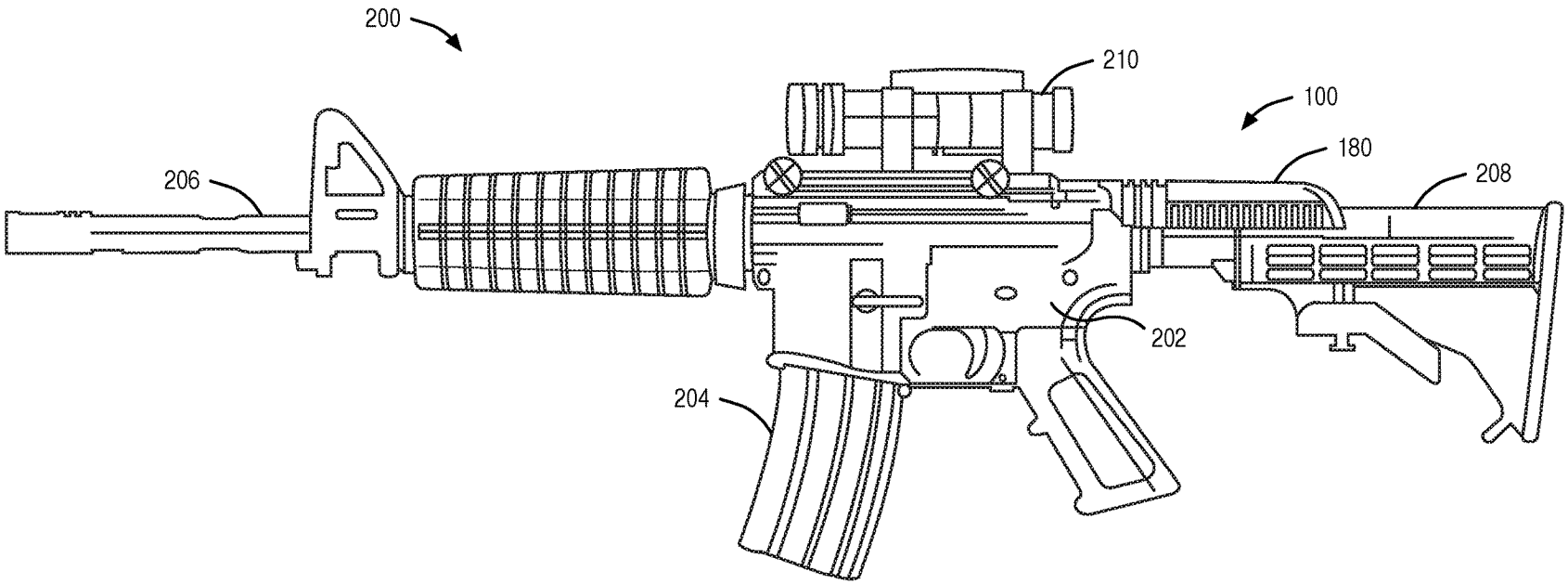
FIG. 1A is a side view of an AR-15 style rifle with a charging handle assembly, according to at least one embodiment, installed and shown in a forward position.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Figure 1B:
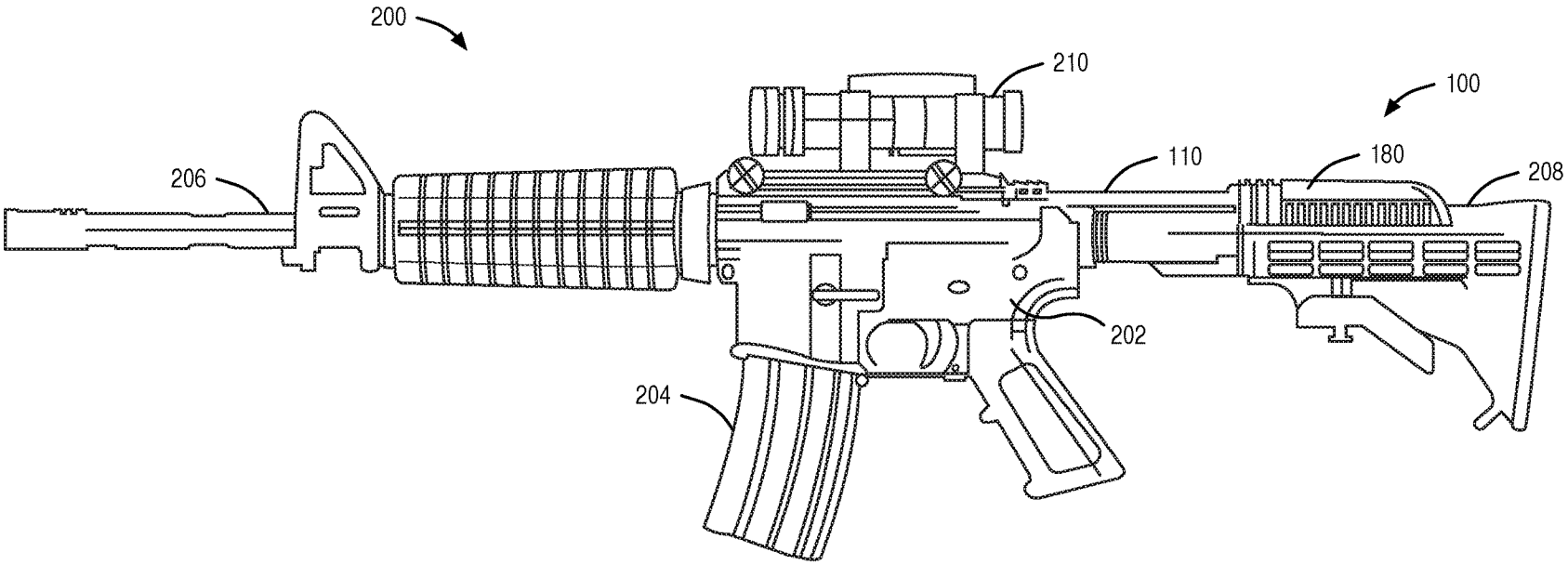
FIG. 1B is a side view of the rifle of FIG. 1A with the charging handle assembly shown in a rearward position.

A charging handle assembly 100, according to at least one embodiment, is shown respectively in forward and rearward positions on an AR-15 style rifle 200 in FIGS. 1A and 1B. With the charging handle assembly 100 in the forward position of FIG. 1A, the rifle 200 is generally ready for firing of ammunition in the magazine 204 in semi-automatic or automatic modes. Once the ammunition in the magazine is spent, or if clearing of the rifle is needed, the charging handle assembly 100 can be drawn back to the rearward position of FIG. 1B to clear the rifle 200. The charging handle assembly 100 can then be pressed forward again to the forward position of FIG. 1A to stow the charging handle assembly 100. If the magazine 204 is reloaded or replaced with a loaded magazine prior to returning the charging handle assembly 100 to the position of FIG. 1A, forward movement of the charging handle assembly 100 effects loading of the rifle 200.

Many configurations of the AR-15 style rifle 200 and similar firearms having rear-receiver charging handles are within the scope of these descriptions. Such firearms are built upon a central receiver 202 and are otherwise highly modular and subject to user preferences with regard to components and their configurations. Thus the rifle in FIGS. 1A and 1B represents merely one example with regard to such options as the length of the barrel 206, the configuration of the stock 208, the selection of the scope sight 210, and many other options. A conventional charging handle typically has a T-handle that does not extend far rearward of the receiver 202 when the charging handle is in the forward position, thus providing little surface area for use in grasping the charging handle and pulling it rearward. A conventional charging handle typically also has a release lever with the T-handle that must be manipulated to free the engagement of the charging handle from the receiver to permit movement toward the rearward position of the charging handle. The charging handle assembly 100 described herein and as illustrated in the drawings, however, has advantageous features over conventional charging handles.

Figure 2:
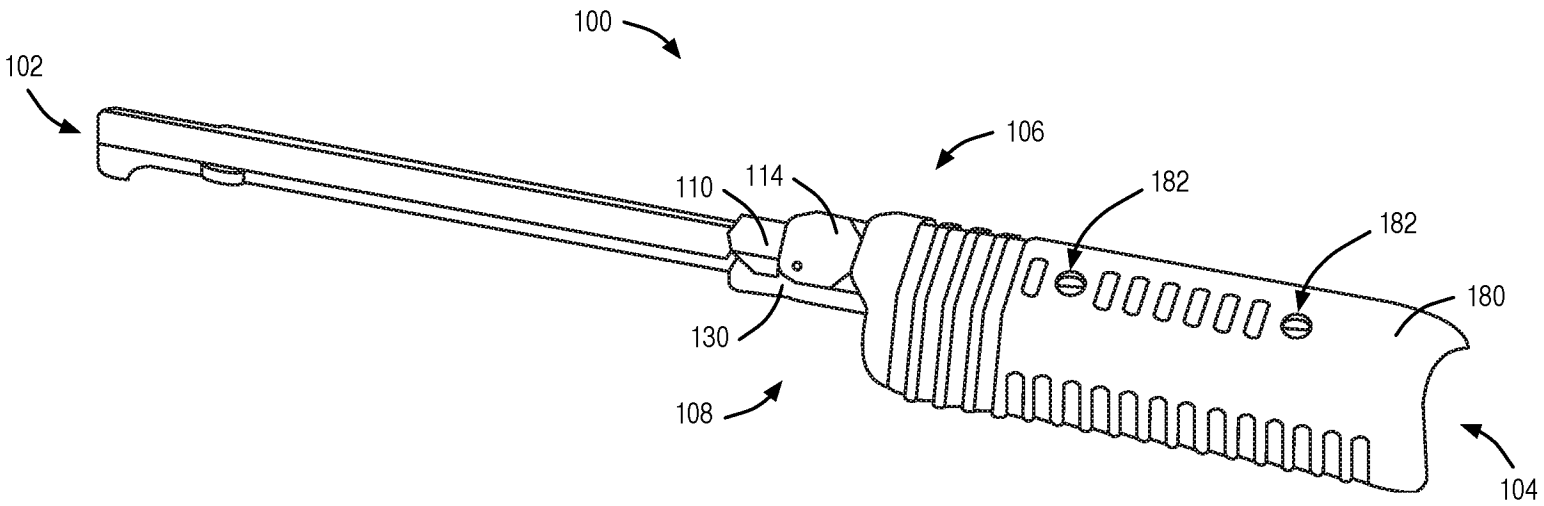
FIG. 2 is a perspective view of the upper side of the charging handle assembly of FIG. 1A
Figure 3:
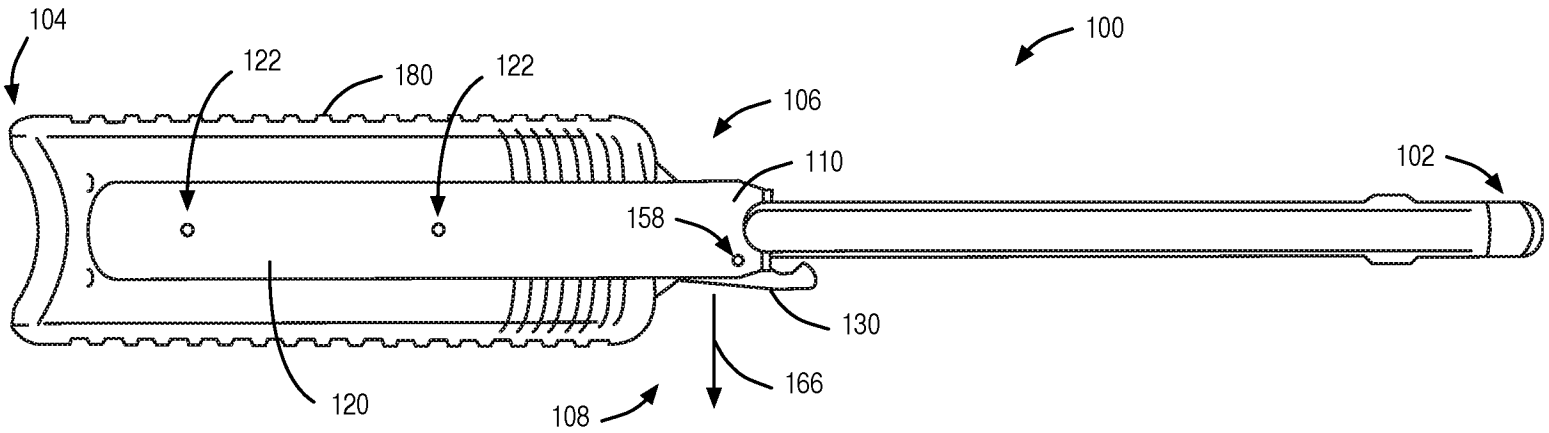
FIG. 3 is a view of the lower side of the charging handle assembly of FIG. 1A.

The charging handle assembly 100 is shown in FIGS. 2 and 3 without a rifle. FIG. 2 is a perspective view of the top and left side the charging handle assembly 100. FIG. 3 is a view of the lower side of the charging handle assembly 100. The charging handle assembly 100 includes a charging handle frame 110, which is further described with reference to FIGS. 4-5, and a cheek rest 180, which is further described with reference to FIG. 7. These descriptions refer to various components having a longitudinal forward end, a longitudinal rearward end, a lateral left side, and a lateral right side. Such references correspond to a shooter's perspective when the charging handle assembly 100 is installed on an AR-15 style rifle for example as shown in FIGS. 1A and 1B. Thus, as shown for example in FIGS. 2-3, the charging handle assembly 100 has a forward end 102 that extends into the upper receiver of an AR-15 style rifle upon installation, a rearward end 104 that extends rearward from the upper receiver, a lateral right side 106, and a lateral left side 108.

Figure 4:
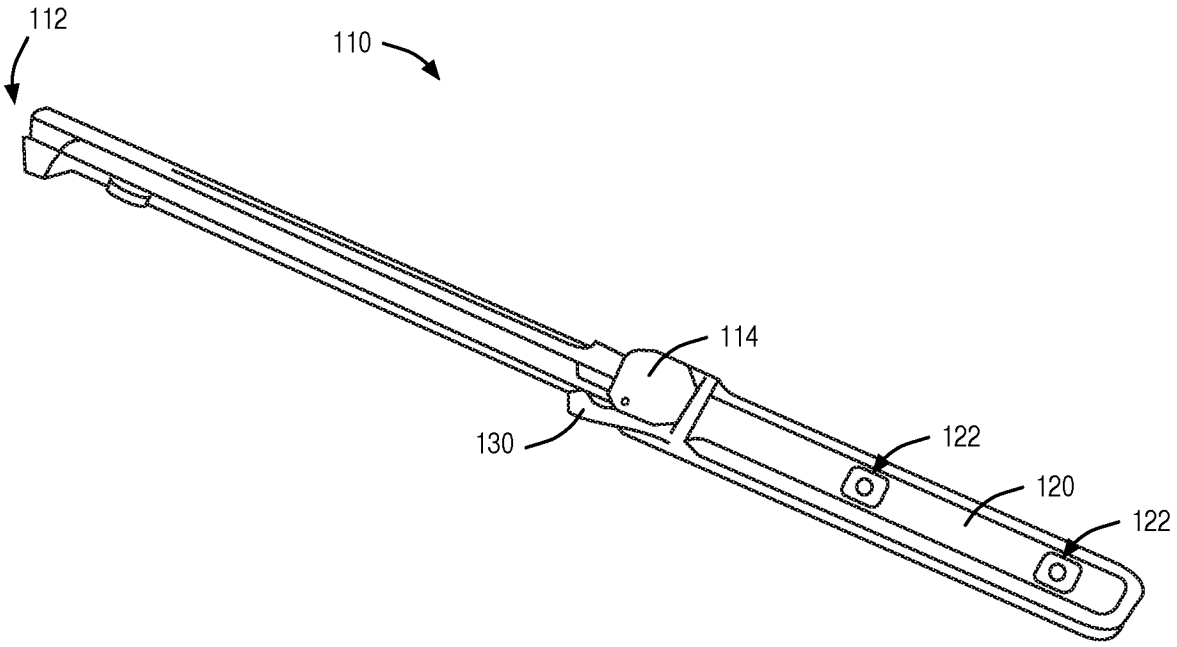
FIG. 4 is a perspective view of the upper side of the frame of the charging handle assembly of FIG. 1A according to at least one embodiment.
Figure 7:
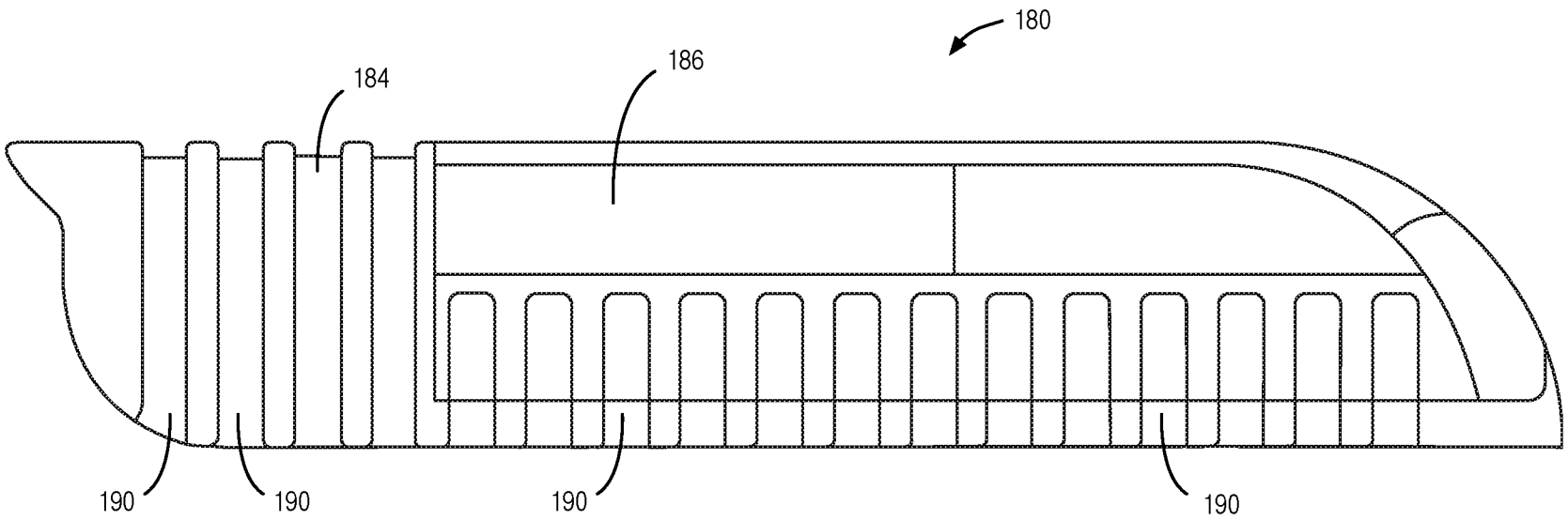
FIG. 7 is a side view of the cheek rest of the charging handle assembly of FIG. 1A according to at least one embodiment.

FIG. 4 shows the charging handle frame 110, without the cheek rest 180, from a similar perspective as shown in FIG. 2. A forward end 112 of the charging handle frame 110 is compatible with the upper receiver and bolt assemblies of conventional AR-15 style rifles. A central portion 114 of the charging handle frame 110 has an upper detent for receiving a rear extension of the upper receiver of a conventional AR-15 style rifle when the forward end 112 is fully inserted in an upper receiver of a rifle. The charging handle frame 110 has a base 120 that extends rearward of the central portion 114 for mounting of the cheek rest 170 (FIG. 7).

Figure 5:
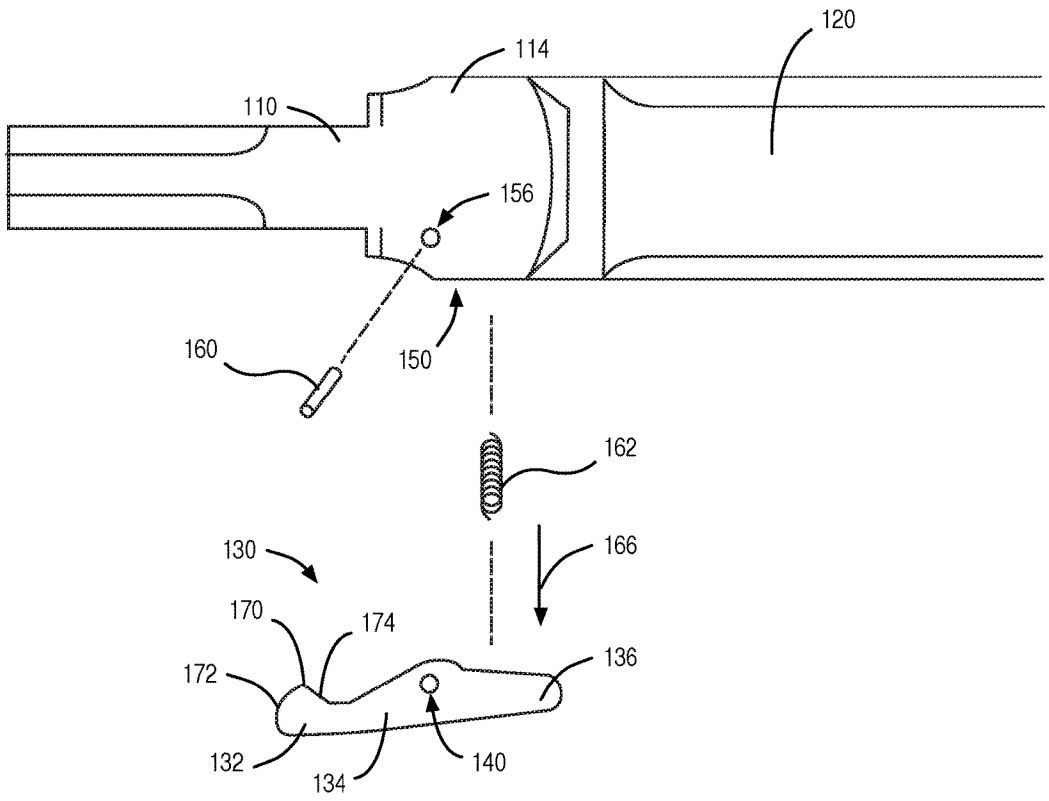
FIG. 5 is an exploded view of a central portion of the frame of FIG. 4.
Figure 6:
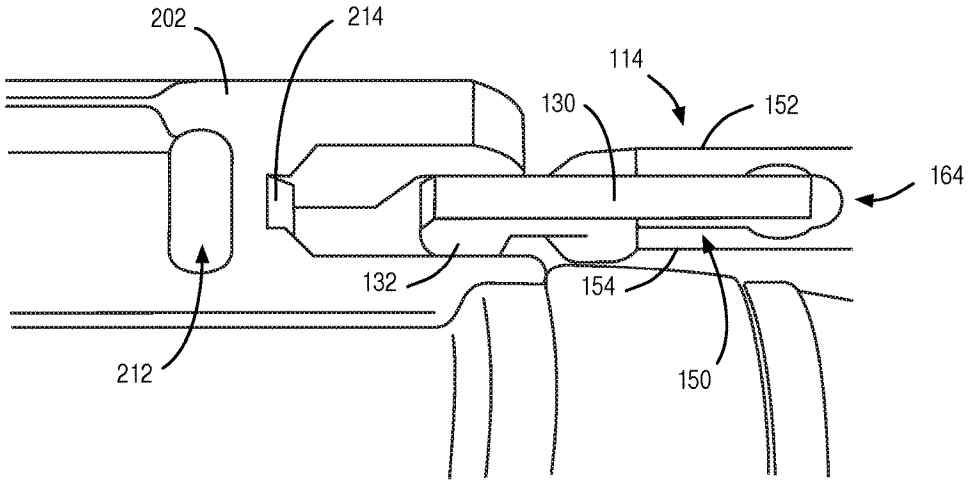
FIG. 6 is a side view of the central portion of the frame of FIG. 4 near engagement with the rifle of FIGS. 1A-1B.

The charging handle frame 110 includes a latch arm 130 (FIG. 4) mounted to the central portion 114. In FIG. 5, the latch arm 130 is shown removed from the handle frame 110, of which only the central portion 114 and adjacent portions of the forward end 112 and base 120 are shown. The latch arm 130 assures engagement of the charging handle assembly 100 in the forward position of FIG. 1A until a user grasps the cheek rest 180 and pulls the charging handle assembly 100 rearward. FIG. 6 is a side view of the central portion 114 of the frame 110 near engagement with the rifle 200 of FIGS. 1A-1B.

The latch arm 130 has a forward hook 132, a central base 134, and rearward lever 136 (FIG. 5). The latch arm 130 is installed partially into a channel 150 (FIG. 6) formed between an upper overhang 152 and a lower overhang 154 extending from the left side of the central portion 114 of the charging handle frame 110. The channel 150 is shown as opening to the lateral left side 108 of the charging handle assembly 100. For assembly, a hole 140 (FIG. 5) extending through the central base 134 of the latch arm 130 is placed into position in the channel 150 between two corresponding vertically aligned holes 156 and 158 (FIG. 3), which are formed respectively through the upper and lower overhangs 152 and 154 (FIG. 6), and a pin 160 (FIG. 5) is pressed into place retaining the latch arm 130 partially within the channel 150. A spring 162 (FIG. 5) is compressed into a receptacle portion 164 (FIG. 6) of the channel 150 rearward of the position of the pin 160 by the lever 136 upon assembly. The pin 160 (FIG. 5) serves as a fulcrum or hinge pin around which the latch arm 130 pivots, with the spring 162 biasing the rearward lever 136 of the latch arm 130 toward a laterally outward direction 166 (FIGS. 3 and 5) from the central portion 114 of the frame 110 and thus biasing the forward hook 132 laterally toward the central portion 114 in a direction opposite the laterally outward direction 166.

When the charging handle frame 110, which is represented in FIG. 6 by the central portion 114 thereof, is pressed into its forward position as shown in FIG. 1A, the forward hook 132 enters and engages a slot 212 formed in the left side of the receiver 202 as shown in FIG. 6. To enter the slot 212, the forward hook 132 is guided outward from the central portion 114 of the charging handle frame 110 by a ramp area 214 of the receiver 202 and ultimately settles or clicks into engagement with the slot 212 when the charging handle assembly 100 reaches the full forward position (FIG. 1A).

Advantageously, the forward hook 132 has an inwardly directed laterally extending tooth 170 having a forward facing ramp 172 to guide the forward hook 132 laterally outward, against the biasing force of the spring 162, upon contact with the receiver 202 and forward motion of the charging handle assembly 100 to reach the full forward position (FIG. 1A). Similarly, the tooth 170 has a rearward facing ramp 174 to guide the forward hook 132 laterally outward, against the biasing force of the spring 162, upon contact with the rearward edge of the slot 212 and rearward motion of the charging handle assembly 100 toward the rearward position (FIG. 1B). Thus, the spring 162 biases the forward hook 132 into engagement with the slot 212, and the forward facing ramp 172 and rearward facing ramp 174 respectively facilitate entry and exit of the tooth 170 into and from the slot 212 without binding or preventative conflict. Each entry and exit of the tooth into and from the slot 212 causes rocking motion of the latch arm 130 around the pin 160.

Thus, the charging handle assembly 100 releasably engages the upper receiver 202 of the firearm 200 in the forward position as shown in FIG. 1A by way of the forward hook 132 and the slot 212 (FIG. 6). The releasable engagement is overcome by pulling rearward on the cheek rest 180 causing the forward hook 132 to exit the slot 212.

The cheek rest 180 serves both as a contact area for the cheek of a user intent on aiming and firing the rifle 200, when the charging handle assembly 100 is in the forward position of FIG. 1A, and as a grasping area of the charging handle assembly 100 when the charging handle assembly 100 is to be drawn back toward the rearward position shown in FIG. 1B. As shown in FIGS. 2 and 3, the cheek rest 180 laterally overhangs and shrouds or cups partially around the base 120 of the charging handle frame 110 along the lateral right side 106 and lateral left side 108 of the charging handle assembly 100.

In the illustrated embodiment, the cheek rest 180 is connected to the charging handle frame 110 by fasteners 182, examples of which are represented by the screw heads in FIG. 2. Holes 122 are formed through the base 120 of the charging handle frame 110 as shown in FIG. 3 to receive and engage the fasteners 182. In an example in which the fasteners 182 are threaded screws, the holes 122 are internally threaded to engage the screws. Other types of fasteners, such as rivets, and other fastening mechanisms or materials by which to connect the cheek rest 180 to the charging handle frame 110 are within the scope of these descriptions.

As shown in FIG. 7, the cheek rest 180 in the illustrated embodiment is constructed as having a rigid hard-shell component 184 for engaging the base 120 of the charging handle frame 110 and an outer softer, flexible, or more pliable contact component 186 attached to or co-molded upon the hard-shell component 184. Ridges 190 are spaced along the cheek rest 180 to facilitate grasping and manipulation by hand even when a glove is worn.

Advantageously, the cheek rest 180 is wider, from its left lateral side to its right lateral side, than the forward end 112 of the charging handle frame 110, which is dimensioned and configured for insertion into an upper receiver of an AR-15 style rifle 200 (FIGS. 1A and 1B). Thus, the cheek rest 180 provides sufficient area for comfortable contact of the cheek of a user during aiming and contact area to the hand of a user when operating the charging handle assembly 100.

To operate the charging handle assembly 100, for example when loading or unloading of the rifle 100 of FIGS. 1A and 1B is needed or when a jam occurs, a right handed shooter could leave their right hand on the trigger assembly of the rifle, slightly elevate their cheek from the cheek-rest cover 180, and use their left hand to grasp the cheek-rest cover 180 and draw the charging handle assembly 100 rearward away from the receiver 202 of the rifle. Upon clearing of the rifle and or placement of a loaded magazine 204, the user can move their left hand, grasping the cheek-rest cover 180, forward towards the receiver 202 and drop their cheek from the slightly elevated position and into engagement with the cheek-rest cover 180 to return to a firing position. The opposite hands would be used for a left handed shooter in the immediately preceding descriptions. In this manner, the timing from jam or spent magazine, through clearing or reloading, and to re-assuming a firing position is quicker than likely possible with a conventional charging handle.

In at least one embodiment, an elective spacer can be placed between the cheek rest 180 and the base 120 of the charging handle frame 110 so as to elevate the cheek rest to a desired height, for example to accommodate any particular scope sight 210 or other sighting mechanism.

Furthermore, in the illustrated embodiment, positive engagement, position registration, and orientation of the charging handle frame 110 and cheek rest 180 are assured by mutually engaging top and bottom surface registration features. For example, as shown in FIG. 4, the top surface of the base 120 of the charging handle frame 110 has rectangular registration detents that surround the holes 122 and receive correspondingly shaped registration extensions that protrude from the bottom of the hard-shell component 184 of the cheek rest 180 upon assembly.

A charging handle assembly according to these descriptions: can be installed onto a firearm without the rear stock interfering with the action of the charging handle assembly; provides a wide-area for contact by hand or even gloves for loading and clearing of the rifle; and provides a cheek rest for shooters so they don't have to "chase the red dot" during target acquisition using optics. The additional small amount of weight and mass of the extended charging handle assembly will not negatively affect operation of the platform. Individual operators or shooters will be able to more quickly, efficiently and more comfortably acquire the proper "cheek weld" on the weapons platform. This enables the shooter to get sights on target faster as in the situations of room clearing, raids and the urban combat environment. Installing a charging handle assembly as described here gives a shooter a well-placed cheek rest for rapid return to sight acquisition and firing after re-loading or clearing a jam, and an experienced shooter will develop muscle memory in its use to improve speed and accuracy in any shooting situation.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A charging handle assembly for a firearm, the charging handle assembly comprising:

a charging handle frame having a forward end configured for insertion into an upper receiver of a firearm, a central portion connected to and extending rearward from the forward end, and a base extending rearward from the central portion;

a latch arm having a forward hook, the latch arm attached to the central portion of the charging handle frame, the forward hook biased toward the central portion of the charging handle frame to secure the charging handle frame relative to an upper receiver of a firearm; and a cheek rest attached to the base of the charging handle frame, wherein the base of the charging handle frame has at least one registration detent that engages the cheek rest.

2. The charging handle assembly of claim 1, wherein the cheek rest is laterally wider than the forward end of the charging handle frame.

3. The charging handle assembly of claim 1, wherein the cheek rest comprises:

a rigid component engaging the base of the charging handle frame; and an outer flexible contact component upon the rigid component.

4. The charging handle assembly of claim 3, wherein the cheek rest comprises ridges to facilitate grasping.

5. The charging handle assembly of claim 1, wherein the latch arm further comprises:

a central base connected to the forward hook; and a rearward lever connected to the central base, the rearward lever biased away from the central portion of the charging handle frame.

6. The charging handle assembly of claim 5, further comprising a pin around which the latch arm is pivotable and a spring that biases the rearward lever away from the central portion of the charging handle frame thereby biasing the forward hook toward the central portion of the charging handle frame as the pin serves as a fulcrum.

7. The charging handle assembly of claim 6, wherein the latch arm is installed partially into a channel formed by the charging handle frame.

8. The charging handle assembly of claim 7, wherein the spring is compressed into a receptacle portion of the channel by the rearward lever.

9. The charging handle assembly of claim 7, the channel is formed in a lateral side of the charging handle frame.

10. The charging handle assembly of claim 9, wherein the charging handle frame comprises an upper overhang and a lower overhang between which the channel is defined.

11. The charging handle assembly of claim 5, wherein the forward hook comprises a tooth having a forward facing ramp.

12. The charging handle assembly of claim 11, wherein the forward hook comprises a rearward facing ramp.

13. The charging handle assembly of claim 12, wherein the latch arm is configured to releasably engage the upper receiver of the firearm when the cheek rest is pushed forward and to disengage the upper receiver of the firearm when the cheek rest is pulled rearward.

14. The charging handle assembly of claim 1, wherein the cheek rest cups partially around the base of the charging handle frame.

15. The charging handle assembly according to claim 1, wherein an upper detent is formed in the central portion of the charging handle frame to receive a rearward extension of an upper receiver of a firearm.

16. The charging handle assembly according to claim 1, further comprising at least one fastener attaching the cheek rest to the base of the charging handle frame.

17. The charging handle assembly according to claim 16, wherein the at least one fastener is received and engaged by a hole formed through the base of the charging handle frame.

18. The charging handle assembly according to claim 17, wherein the at least one fastener is a threaded screw.

19. The charging handle assembly according to claim 18, wherein the threaded screw has a head that engages the cheek rest.

* * * * *